US011059556B2

(12) United States Patent
Ahlgren

(10) Patent No.: US 11,059,556 B2
(45) Date of Patent: Jul. 13, 2021

(54) TROLLING MOTOR SEALING SYSTEM

(71) Applicant: Garmin Switzerland GmbH, Schaffhausen (CH)

(72) Inventor: Austin W. Ahlgren, Lenexa, KS (US)

(73) Assignee: Garmin Switzerland GmbH

( * ) Notice: Subject to any disclaimer, the term of this patent is extended or adjusted under 35 U.S.C. 154(b) by 0 days.

(21) Appl. No.: 16/782,932

(22) Filed: Feb. 5, 2020

(65) Prior Publication Data

US 2021/0001967 A1 Jan. 7, 2021

Related U.S. Application Data

(60) Provisional application No. 62/870,408, filed on Jul. 3, 2019.

(51) Int. Cl.

| | |
|---|---|
| ***B63H 20/14*** | (2006.01) |
| ***B63H 20/32*** | (2006.01) |
| ***B63H 20/00*** | (2006.01) |

(52) U.S. Cl.

CPC ..... *B63H 20/14* (2013.01); *B63H 20/007* (2013.01); *B63H 20/32* (2013.01); *B63B 2201/18* (2013.01)

(58) Field of Classification Search

CPC ..... B63H 20/12; B63H 20/14; B63H 20/32; B63H 20/007; B63B 2201/18

See application file for complete search history.

(56) References Cited

U.S. PATENT DOCUMENTS

| | | | | |
|---|---|---|---|---|
| 2,277,637 | A * | 3/1942 | Eby | F16G 11/048 174/153 G |
| 4,835,342 | A * | 5/1989 | Guginsky | H02G 3/0675 174/653 |
| 6,652,331 | B2 * | 11/2003 | Healey | G01S 7/521 440/6 |
| 6,661,742 | B2 | 12/2003 | Hansen | |
| 6,870,794 | B2 | 3/2005 | Healey | |
| 6,899,574 | B1 | 5/2005 | Kalis et al. | |
| 9,893,507 | B2 * | 2/2018 | Findley | H02G 15/013 |
| 10,351,220 | B1 * | 7/2019 | Witte | B63H 20/32 |

OTHER PUBLICATIONS

Printout from https://en.wikipedia.org/wiki/Compression_seal_fitting, published prior to Feb. 5, 2020.

* cited by examiner

*Primary Examiner* — Stephen P Avila

(74) *Attorney, Agent, or Firm* — Samuel M. Korte; Max M. Ali

(57) ABSTRACT

A downshaft assembly for supporting a motor assembly of a watercraft and for enclosing a cable of a transducer assembly fixed to the motor assembly. The downshaft assembly includes a base having an exterior surface, an interior surface, and a surface defining a hole extending between the interior surface and the exterior surface. The downshaft assembly also includes a nut and a grommet having a tapered portion at least partially disposed in the hole. The grommet is configured to receive the cable therethrough and the nut is positioned against the grommet and removably secured to the base, with the positioning of the secured nut compressing at least part of the tapered portion of the grommet against the surface defining the hole.

20 Claims, 15 Drawing Sheets

TROLLING MOTOR SEALING SYSTEM

RELATED APPLICATIONS

The present application is a non-provisional application which claims priority benefit with regard to all common subject matter to U.S. Provisional Application Ser. No. 62/870,408, filed Jul. 3, 2019, which is hereby incorporated by reference in its entirety into the present application as if fully set forth herein.

BACKGROUND

Trolling motors for watercraft commonly include sonar transducers. The transducers obtain information (e.g., sonar data) about surrounding animals, objects and terrain, with the information being converted to images for display. Signal transmission cables for the transducers may either extend along an exterior of the motor and up a supporting shaft to the watercraft, or be permanently embedded within the watertight cavities of the motor. Permanently-embedded cables share a path to the watercraft with trolling motors' lead cables and the like, and are therefore protected from collision with surrounding objects more so than exterior-mounted cables. However, exterior-mounted cables have traditionally offered users the option of replacing a damaged or outdated transducer element, where permanently-embedded cables have not.

SUMMARY

Embodiments of the present technology provide an improved downshaft assembly that is suitable for supporting a motor assembly and protecting a cable of an interchangeable transducer assembly fixed to the motor assembly. An embodiment of the downshaft assembly includes a base having an exterior surface, an interior surface, and a surface defining a hole extending between the interior surface and the exterior surface. The downshaft assembly also includes a nut and a grommet having a tapered portion at least partially disposed in the hole. The grommet is configured to receive the cable therethrough and the nut is positioned against the grommet and removably secured to the base, with the positioning of the secured nut compressing at least part of the tapered portion of the grommet against the surface defining the hole.

Embodiments of the present technology also or alternatively provide an improved motor assembly that is suitable for protecting a cable of an interchangeable transducer assembly fixed to the motor assembly. An embodiment of the motor assembly includes a motor including a rotor, a case containing the rotor and having a bottom outer surface, and a nose cone having a bottom wall. The bottom wall is configured to be secured against the transducer element. The nose cone is removably fixed to the case to define a heat exchange cavity between the bottom wall and the bottom outer surface of the case. The nose cone is configured to permit ingress of liquid into the heat exchange cavity from an ambient environment.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
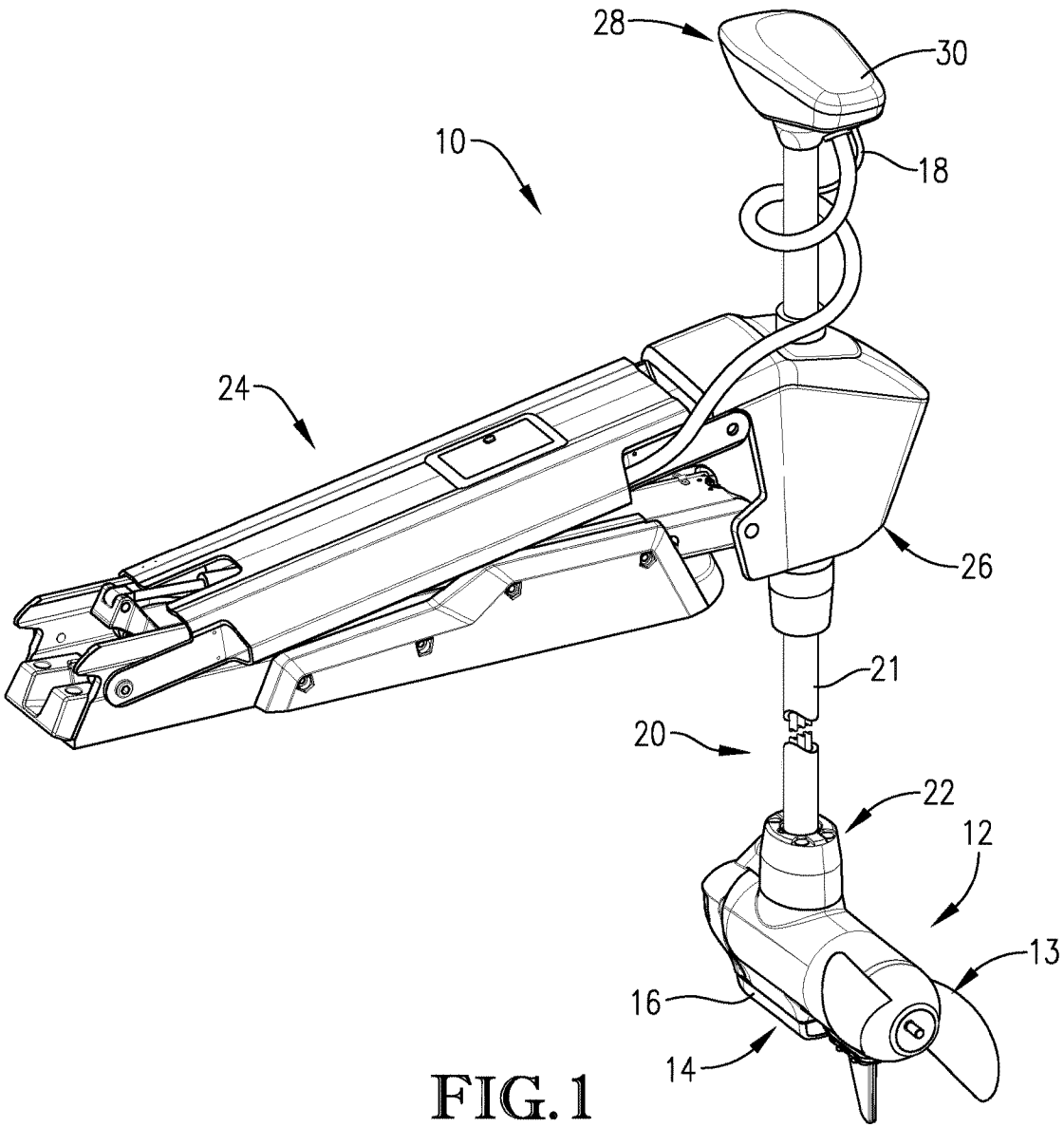
FIG. 1 is a side perspective view of a trolling motor incorporating an improved downshaft assembly and motor assembly constructed in accordance with embodiments of the present technology.

The drawing figures do not limit the present technology to the specific embodiments disclosed and described herein. While the drawings do not necessarily provide exact dimensions or tolerances for the illustrated components or structures, the drawings are to scale as examples of certain embodiments with respect to the relationships between the components of the structures illustrated in the drawings.

DETAILED DESCRIPTION

The following detailed description of the technology references the accompanying drawings that illustrate specific embodiments in which the technology can be practiced.

The embodiments are intended to describe aspects of the technology in sufficient detail to enable those skilled in the art to practice the technology. Other embodiments can be utilized and changes can be made without departing from the scope of the present technology. The following detailed description is, therefore, not to be taken in a limiting sense.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present technology relate to a sealing system for a trolling motor attachable to a transducer assembly. A transducer assembly typically comprises a transducer element and a cable. The cable communicates electric signals between the transducer element and a processing element. More particularly, the transducer element generally receives electric signals from the processing element and transmits corresponding acoustic energy into the surroundings (e.g., a surrounding aquatic environment). The transducer element also receives acoustic echoes from the surroundings and converts the echoes into electric signals for transmission to and interpretation by the processing element. Typically, this interpretation results in imaging of the surroundings on a display.

Imaging based on the transducer element's electric signals is optimized by maintaining the transducer element in a line of sight to the surroundings to be visualized. Because transducer elements are often used to assist in the location of fish beneath a watercraft and/or to view the floor of an aquatic environment, they may be mounted on the underside of trolling motors.

Corresponding transducer signal transmission cables may either extend along an exterior of the motor and up a supporting shaft to the watercraft, or be permanently embedded within the watertight cavities of the motor. Permanently-embedded cables may share a path to the watercraft with a motor's lead cables or the like, and therefore be protected from collision with surrounding objects more so than exterior-mounted cables. However, exterior-mounted cables have traditionally offered users the option of replacing a damaged or outdated transducer element, where conventional permanently-embedded cables have not.

Embodiments of the present technology provide a sealing system enabling a user to replace all or some of a transducer assembly and to provide protection for the corresponding data cable along its path to the watercraft.

A trolling motor according to embodiments of the present technology is configured for attachment to a transducer assembly. The trolling motor includes a motor assembly and a downshaft assembly having a base. The motor assembly includes a motor (such a direct current (DC) electric motor) partially or wholly disposed within a motor compartment and enclosed by a motor case. The motor case may seal the motor compartment against ingress of liquid from the surroundings, as discussed in more detail below.

The motor assembly is attached to the base of the downshaft assembly. The base includes an interior surface at least partly defining an interior passage. The interior passage extends from the base upward inside a shaft of the downshaft assembly to provide a path to control elements of the trolling motor and/or transducer element, also as discussed in more detail below.

The base defines a hole between the interior passage and an exterior of the base. The base receives a transducer cable through the hole. In configurations, the transducer cable bypasses the motor case—thereby preserving the integrity of its primary structural components—and instead first enters the interior passage via the hole of the base. The hole is sealed against ingress of liquids from the surroundings by a removable nut and tapered grommet configured for receiving the cable therethrough. Embodiments of the present technology provide a sealing system that permits replacement of all or some of a transducer assembly while preserving the integrity of a motor case and protecting a transducer cable from object collisions.

Further, one configuration of the present technology improves motor cooling and transducer cable protection by providing a nose cone removably attached to the motor case. The nose cone has a nose portion adjacent an axial end of the motor case, and a bottom wall adjacent a bottom outer surface of the motor case. The bottom wall is configured to be secured against a transducer element along one side, and to define a heat exchange cavity along an opposite, second side in cooperation with the bottom outer surface of the motor case. The nose portion also includes a wall, and the wall of the nose portion defines a second heat exchange cavity in cooperation with the axial end of the motor case. The first and second heat exchange cavities are configured to permit ingress of liquid from the surroundings, are in fluid communication with each other, and are configured to define a path for the transducer cable between the transducer element and the hole of the base of the downshaft assembly.

Figure 2:
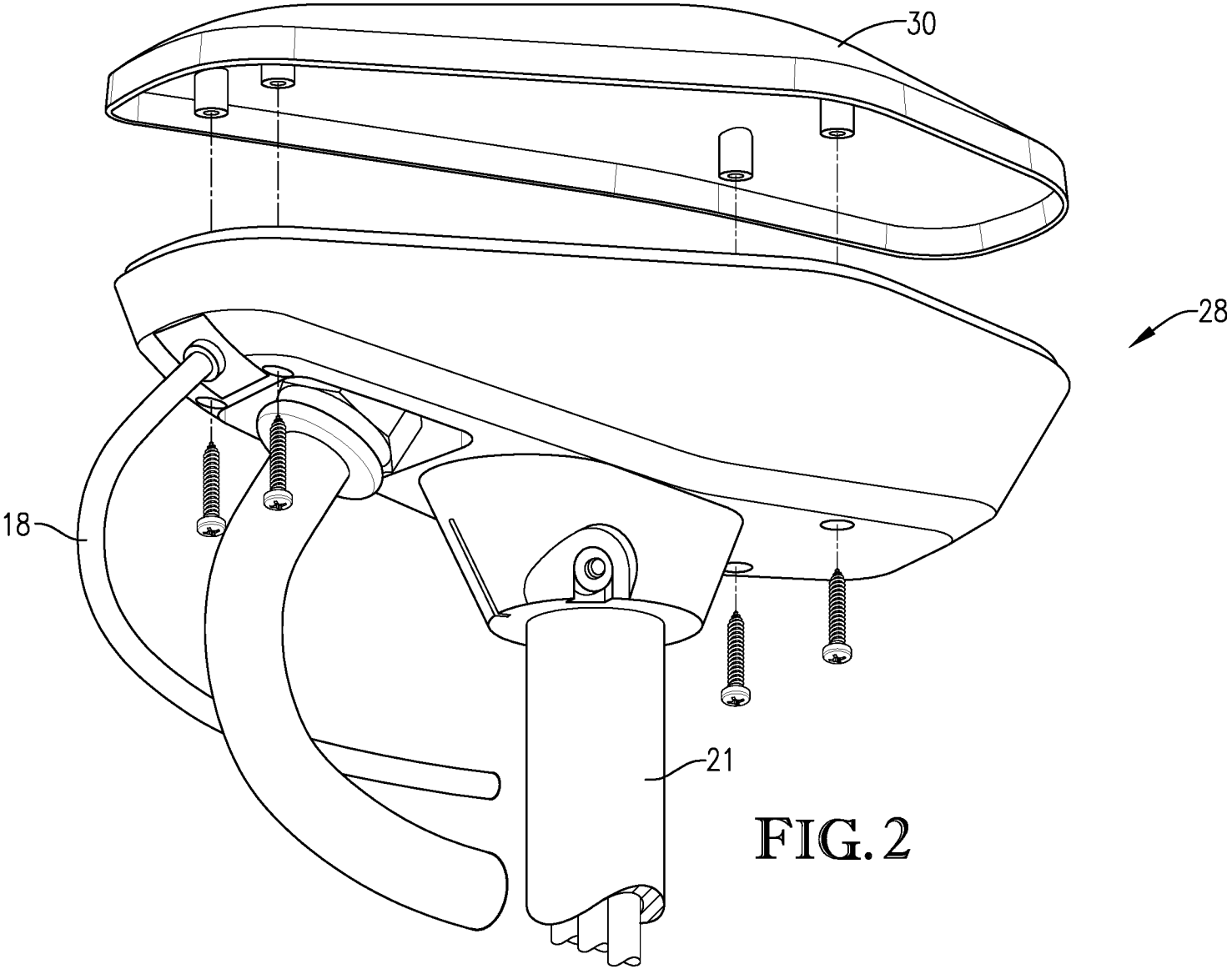
FIG. 2 is an exploded view of a shaft cap of the downshaft assembly of FIG. 1.
Figure 3:
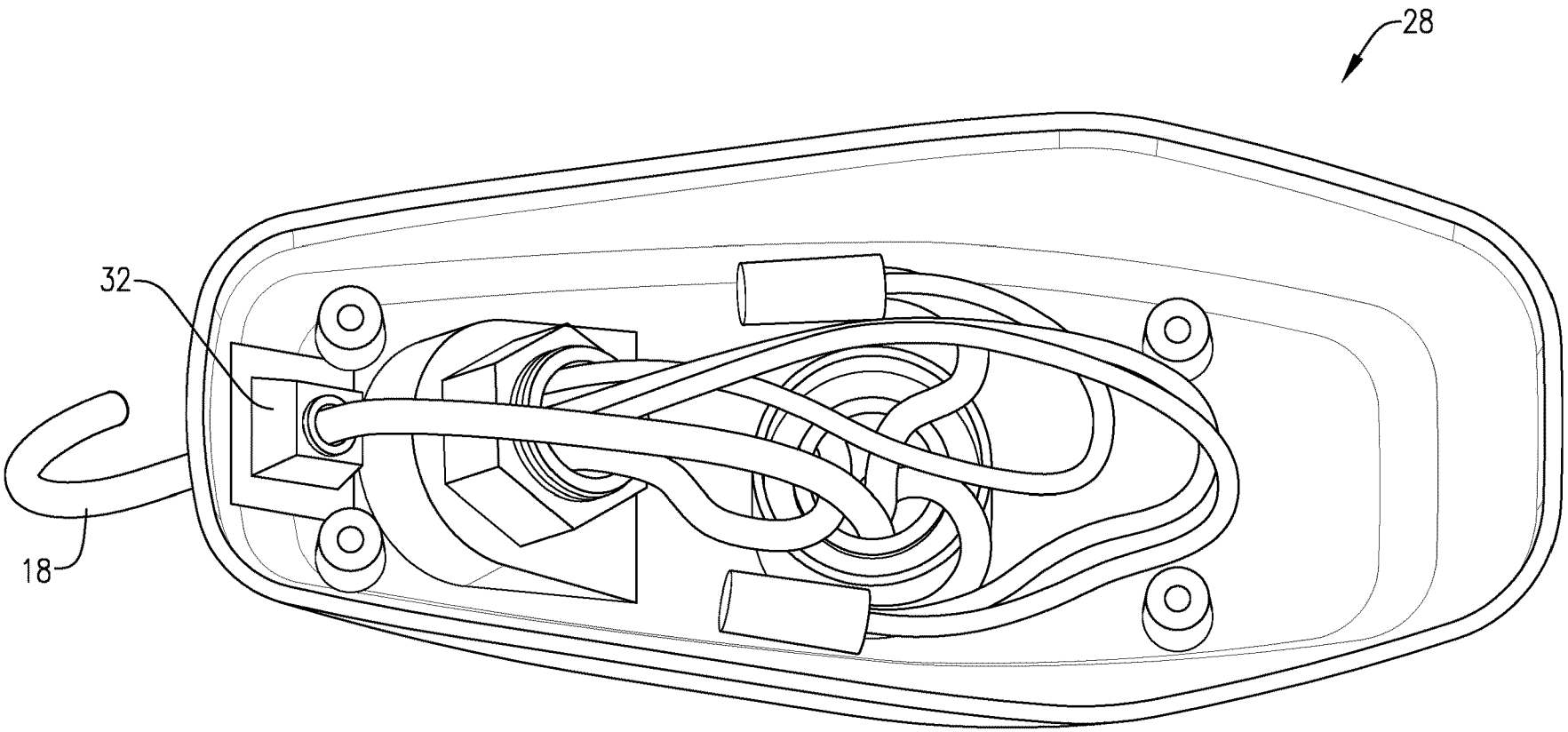
FIG. 3 is a top elevation of the shaft cap of FIG. 2, illustrated without a removable cover.
Figure 4:
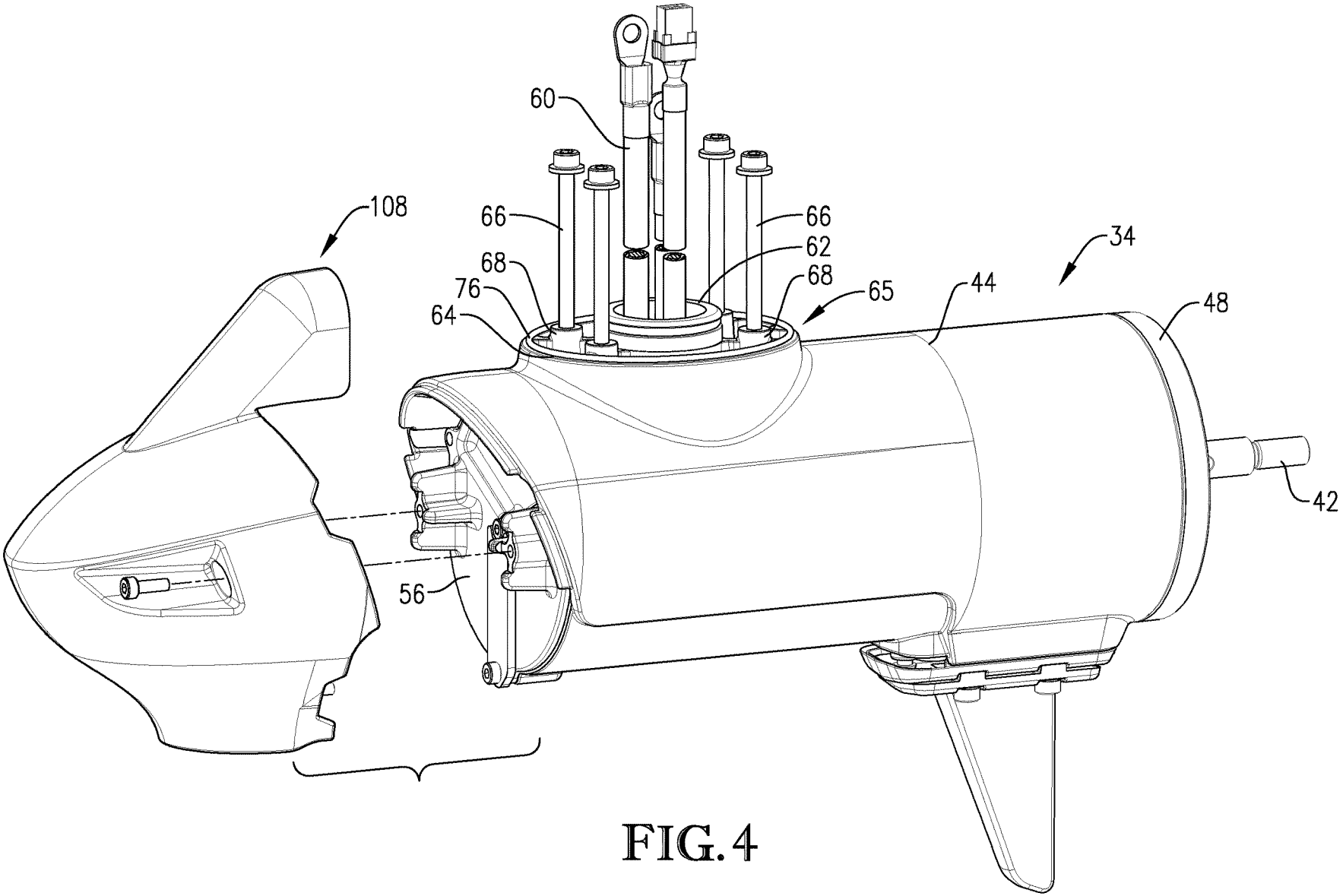
FIG. 4 is a partial exploded view of the motor assembly of FIG. 1, with a nose cone of the motor assembly illustrated without a bottom wall.

Embodiments of the technology will now be described in more detail with reference to the drawing figures. Referring to FIGS. 1-3, a trolling motor 10 includes a motor assembly 12 having a propeller 13. The motor assembly 12 is attached to a transducer assembly 14. The transducer assembly 14 includes a downward-facing transducer element 16 and a cable 18. One of ordinary skill will appreciate that a transducer element may comprise a transducer array for generating sonar beams or the like within the scope of the present technology. It is foreseen that a transducer element may be of sidescan and/or conical configurations with respect to a motor assembly and/or may implement frequency-steered sonar beams without departing from the spirit of the present technology. Moreover, it is foreseen that other types of sensors or devices—such as lights, cameras, speakers or the like—may replace a transducer element without departing from the spirit of the present technology.

The trolling motor 10 includes a downshaft assembly 20 having a shaft 21 and a base 22 removably attached to the motor assembly 12, as discussed in more detail below. The downshaft assembly 20 is attached to a mounting assembly 24 by a steering assembly 26. The mounting assembly 24 is configured to be secured to a watercraft (not shown). The steering assembly 26 is attached to the mounting assembly 24 and may control rotation of the downshaft assembly 20 relative to the mounting assembly 24, as is generally known in the art.

The trolling motor 10 also includes a shaft cap 28 removably fixed to an end of the shaft 21 opposite the motor assembly 12. The shaft cap 28 includes a removable cover 30 and a grommet 32. The shaft cap 28 provides an enclosed space or hub for connecting permanent and non-permanent electrical cables, such as power/data cables associated with the trolling motor 10. For instance, the transducer cable 18 passes through the grommet 32 and into the interior of the shaft cap 28 where it terminates at a terminal (not shown). The terminal may comprise an electrical interface with a permanent cable in electrical communication with a chartplotter or other imaging equipment (not shown). Such imaging equipment may include a user interface comprising a screen or display and a processing element (including, for example, a processor) configured to transmit instructions for operation of the transducer element 16 and to interpret input from the transducer element 16 for imaging of the surroundings, as is generally known in the art. One of ordinary skill will appreciate that a shaft cap may be omitted or varied within the scope of the present technology.

Turning to FIGS. 4-8 and 15, the motor assembly 12 includes a case 34 circumscribing a motor 36. The motor 36 includes a rotor 38 (see FIG. 15), a stator 40 and a shaft 42 fixed to or integral with the rotor 38. The shaft 42 defines a rotational axis A. The case 34 is generally cylindrical and includes a shell 44 and axially-opposing endbells 46, 48. The endbells 46, 48 respectively include bearings 50, 52 configured to rotatably receive the shaft 42. The shell 44 and endbells 46, 48 cooperatively define a motor compartment 54 (see FIG. 15) housing the rotor 38 and stator 40. It is foreseen that a shell and endbells may substantially seal a motor compartment against the ingress of liquids from an exterior without departing from the spirit of the present technology.

In an embodiment of the present technology, "substantial sealing" of a compartment, passage or space against ingress of liquids may be achieved with reference to a particular application. For instance, substantial sealing of a structure designed for prolonged water exposure at a relatively shallow depth may be determined by an ingress protection rating of at least seven (7) in a liquid category measured according to INTERNATIONAL ELECTROTECHNICAL COMMISSION® (IEC™) 60529, "Degrees of Protection Provided by Enclosures" (the "IP Rating"). In another embodiment, substantial sealing of a structure designed to be submerged at depth for a prolonged period of time may correspond to an IP Rating in the liquid category of at least eight (8). In each case, the exemplary IP Ratings are determined according to standards promulgated at the time of the earliest priority filing hereof. One of ordinary skill will appreciate, however, that a variety of methods and standards may be employed, and that the degree of sealing required for a particular application may vary, within the scope of the present technology.

The motor case 34 also includes a secondary bulkhead 56 axially-spaced from the endbell 46. Except where an internal passage (discussed below) extends through the shell 44, the shell 44 extends axially from the endbell 46 and seals against the secondary bulkhead 56 to cooperatively define a terminal compartment 58. The trolling motor 10 includes power and/or control wires 60 (e.g., phase winding wires, a neutral wire and/or control wires) for the motor 36 that are received within the terminal compartment 58 and are connected to corresponding motor terminal wires (not shown) extending into the motor compartment 54 for powering, grounding and/or controlling operation of the motor 36. In configurations, the terminal compartment 58 and the motor compartment 54 are substantially sealed against the ingress of liquids from an exterior of the motor case 34.

Turning to FIGS. 8-15, the case 34 includes two concentric collars 62, 64 projecting from an upper portion 65 of the shell 44. The base 22 of the downshaft assembly 20 is secured against the collars 62, 64 via fasteners 66. More particularly, the fasteners 66 are inserted through holes 67 in the base 22 and secured to bosses 68 formed in the upper portion of the shell 44 between the collars 62, 64. The base 22 includes annular lips 70, 72 respectively fastened against the collars 62, 64. An o-ring 74 is sealingly secured between the collar 62 and the lip 70, and an o-ring 76 is sealingly secured between the collar 64 and the lip 72. One of ordinary skill will appreciate that various structures may be employed to matingly and/or sealingly engage a case with a downshaft assembly, and that a downshaft assembly and a case may be monolithic, within the scope of the present invention.

Figure 5:
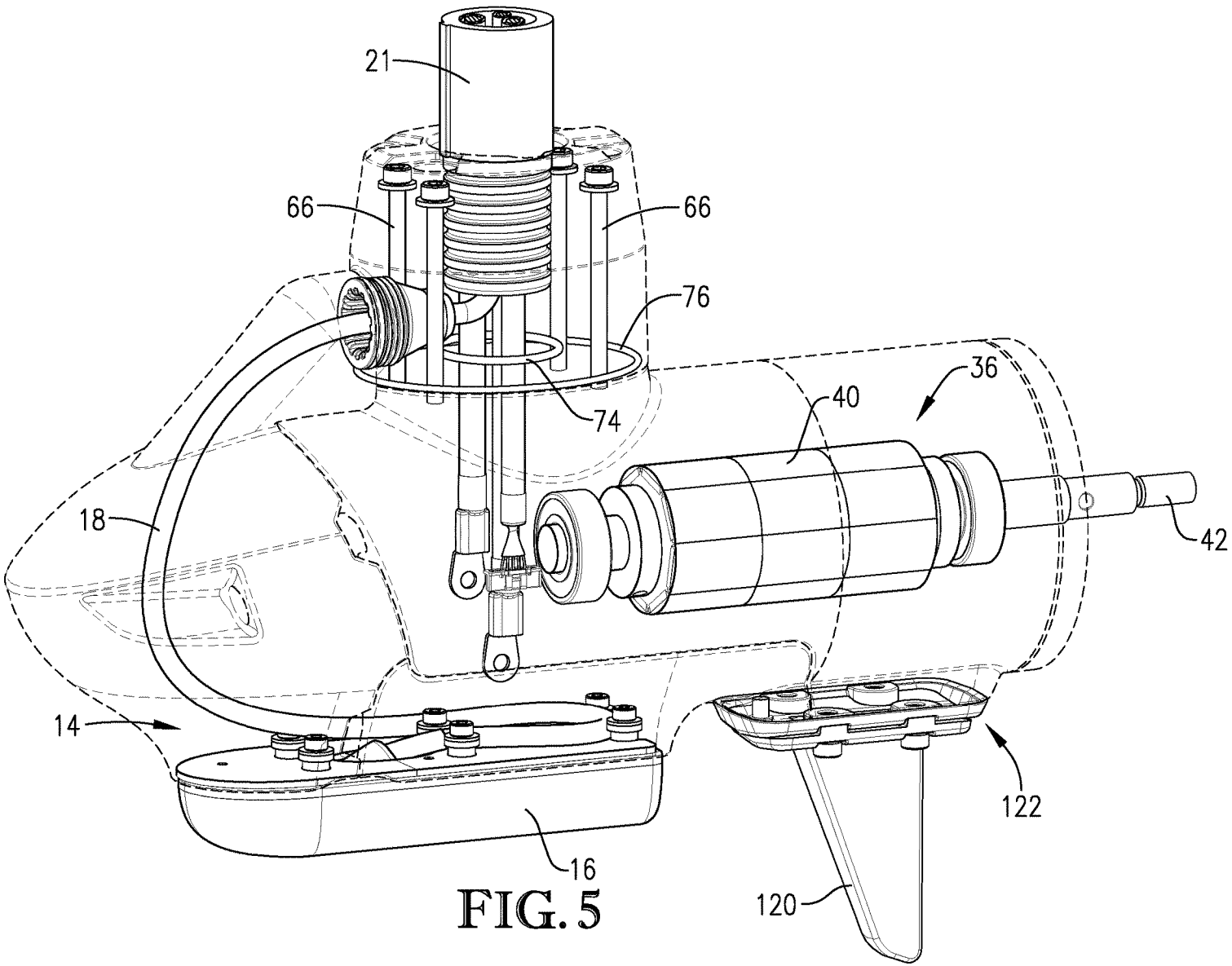
FIG. 5 is a partial front perspective view of the downshaft assembly and the motor assembly of FIG. 1, with the nose cone and case of the motor assembly and a base of the downshaft assembly hidden and outlined in broken lines to reveal interior details of the motor assembly and the downshaft assembly.
Figure 6:
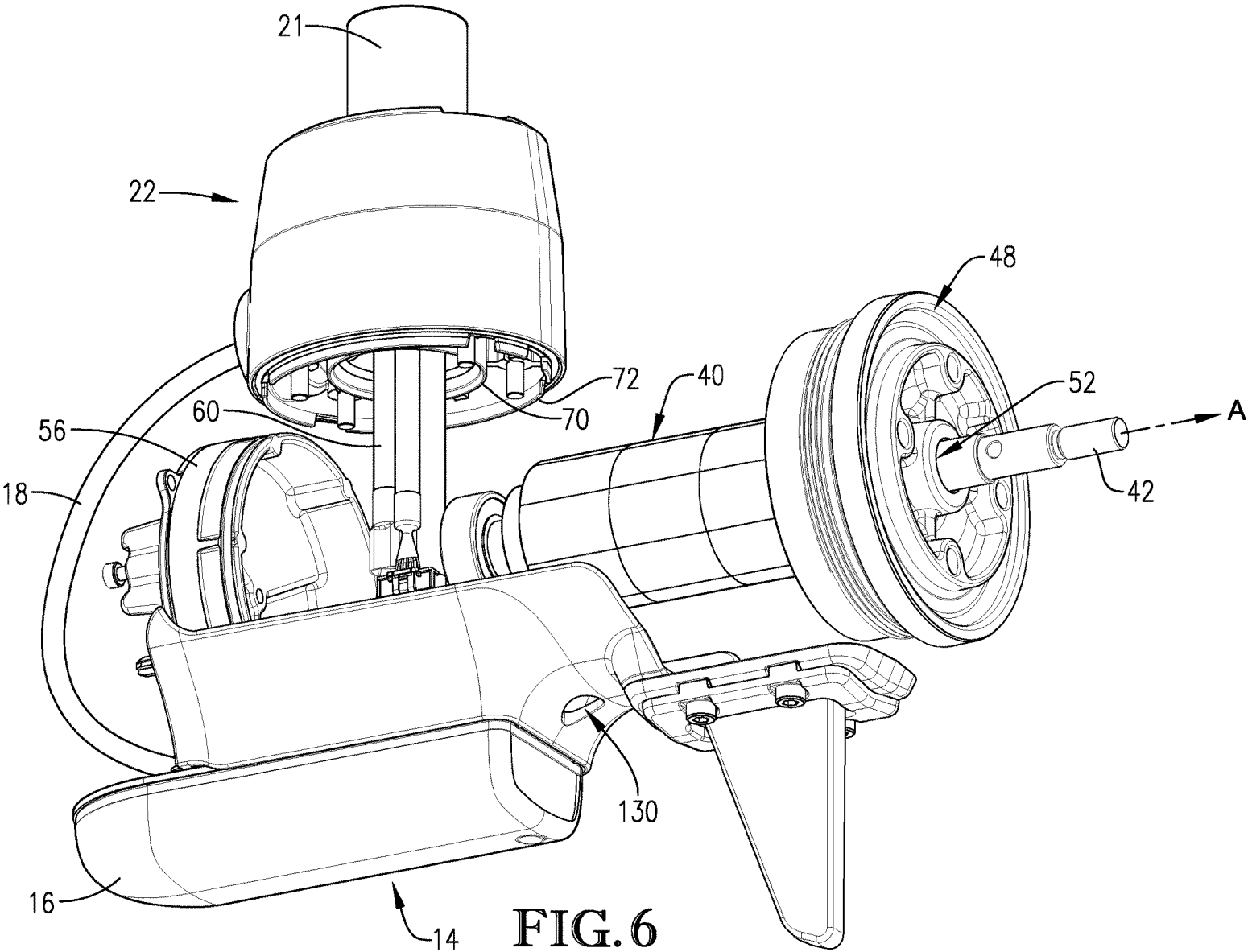
FIG. 6 is rear perspective view of the downshaft assembly and the motor assembly of FIG. 5, with the bottom wall of the nose cone, the base and portions of the case being illustrated and remaining broken lines indicating hidden parts removed.
Figure 7:
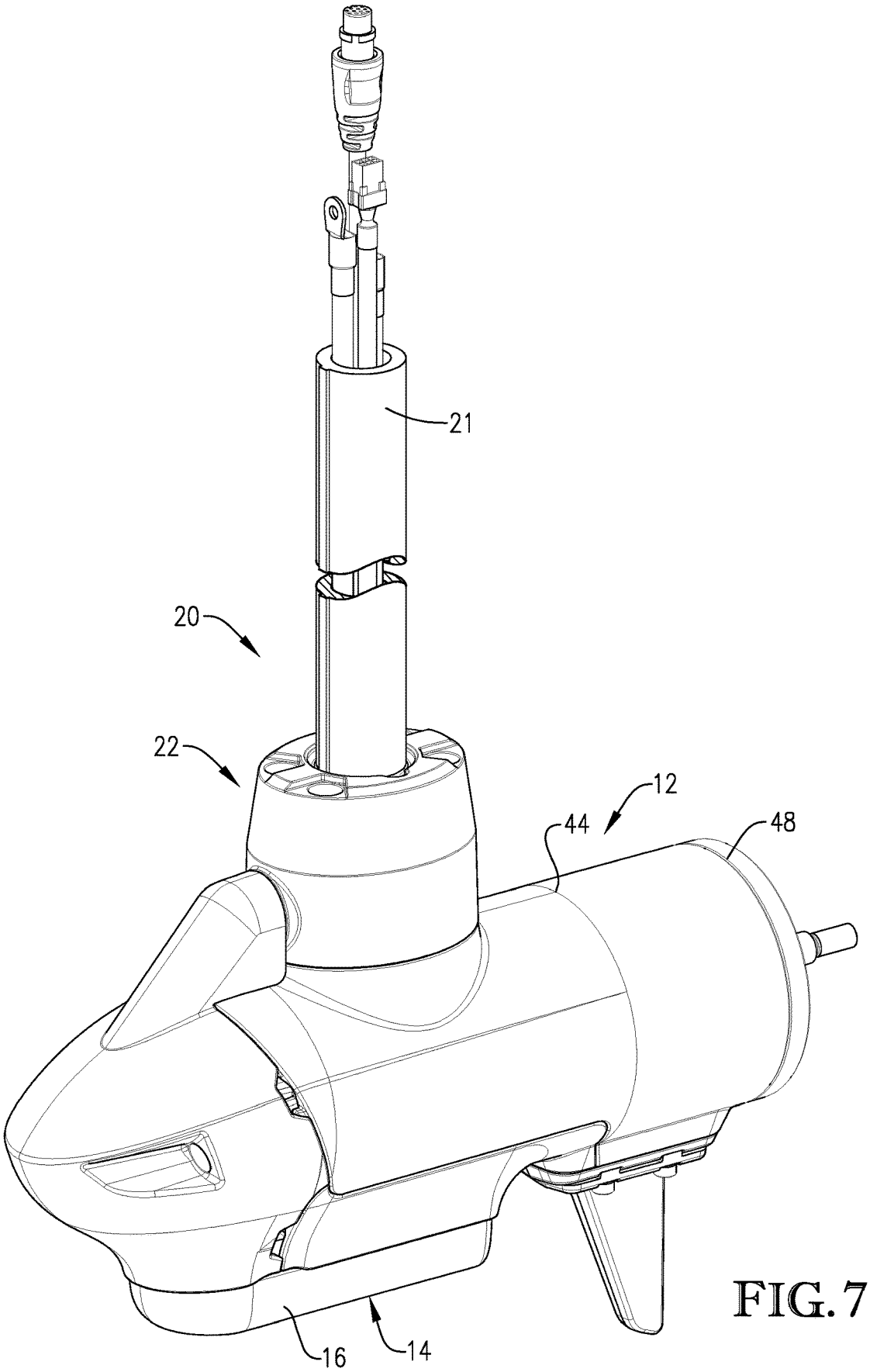
FIG. 7 is a partial front perspective view of the downshaft assembly and the motor assembly of FIG. 1.
Figure 8:
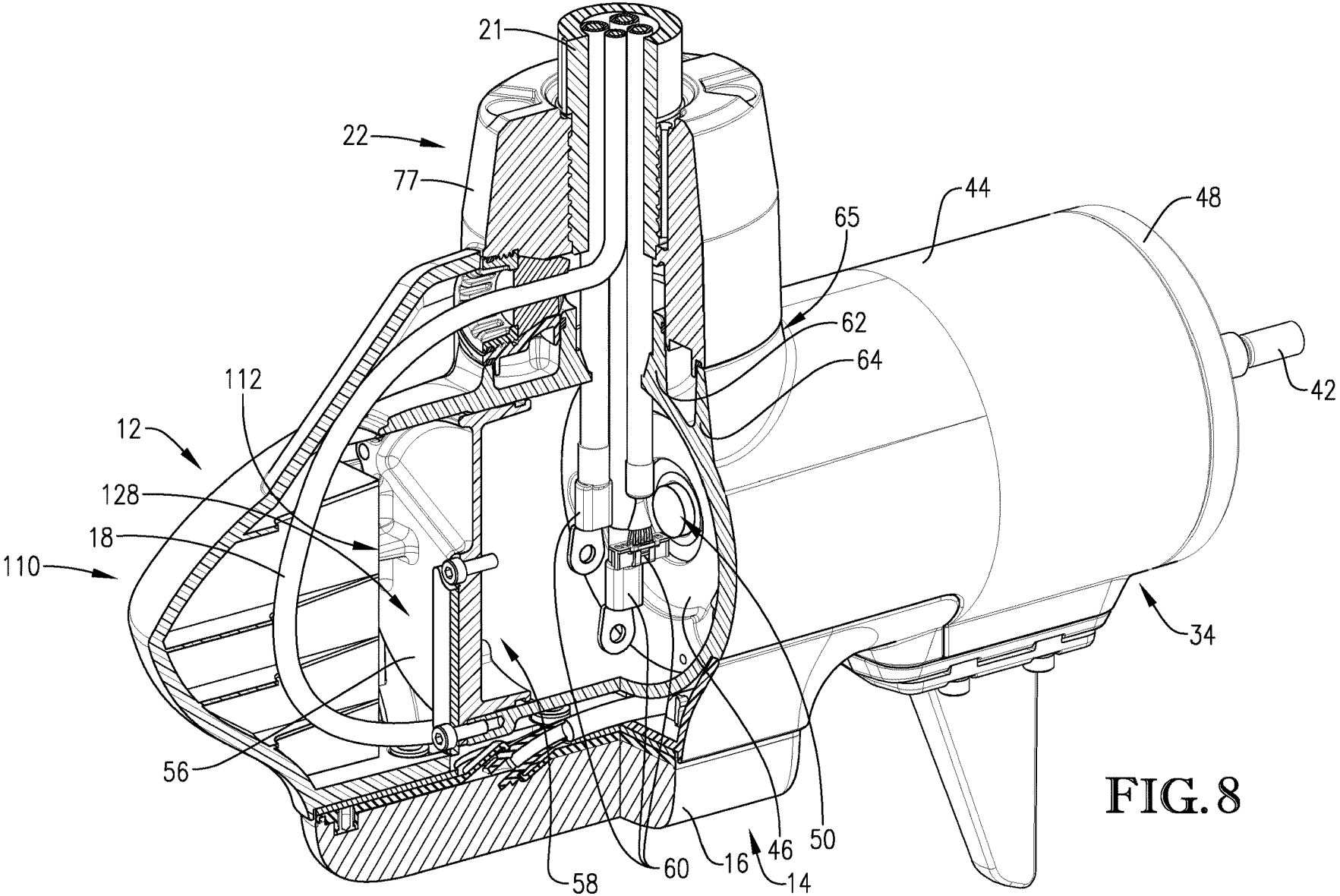
FIG. 8 is a cutaway view of the downshaft and motor assemblies of FIG. 1, illustrating heat exchange cavities, a terminal compartment and an interior passage.
Figure 9:
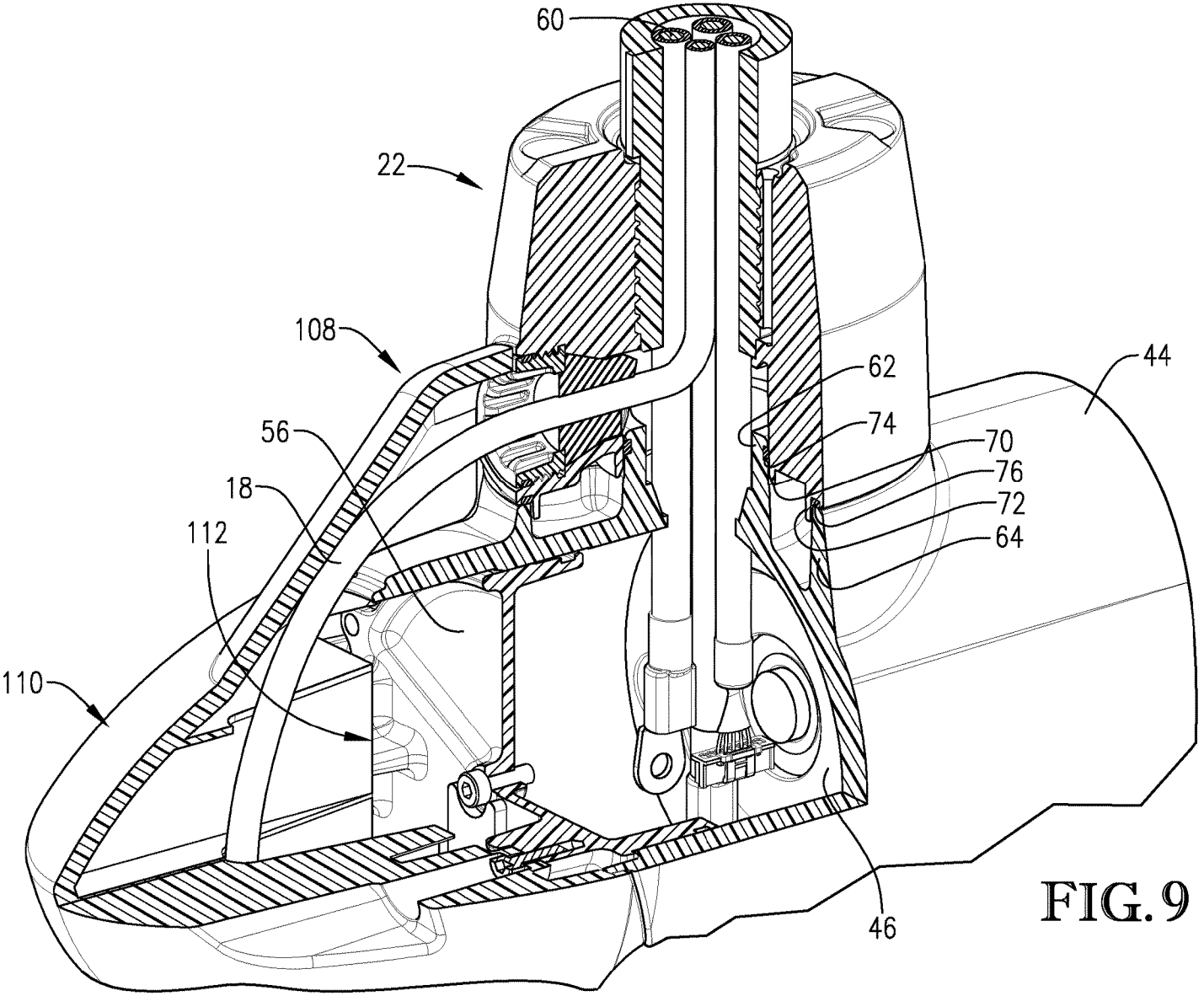
FIG. 9 is an enlarged partial view of the cutaway of FIG. 8.
Figure 10:
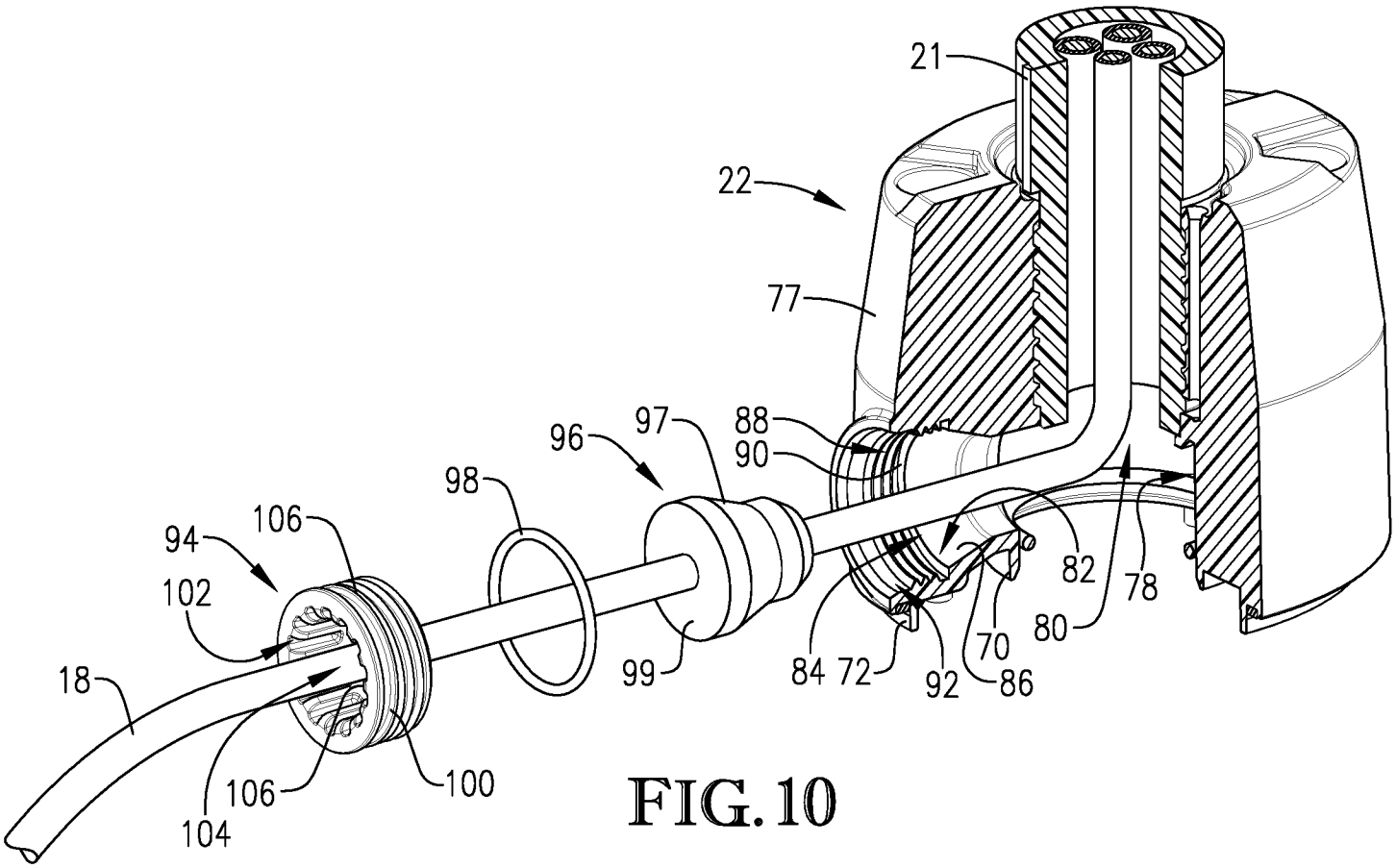
FIG. 10 is an exploded view of the base of the downshaft assembly of FIG. 9.
Figure 11:
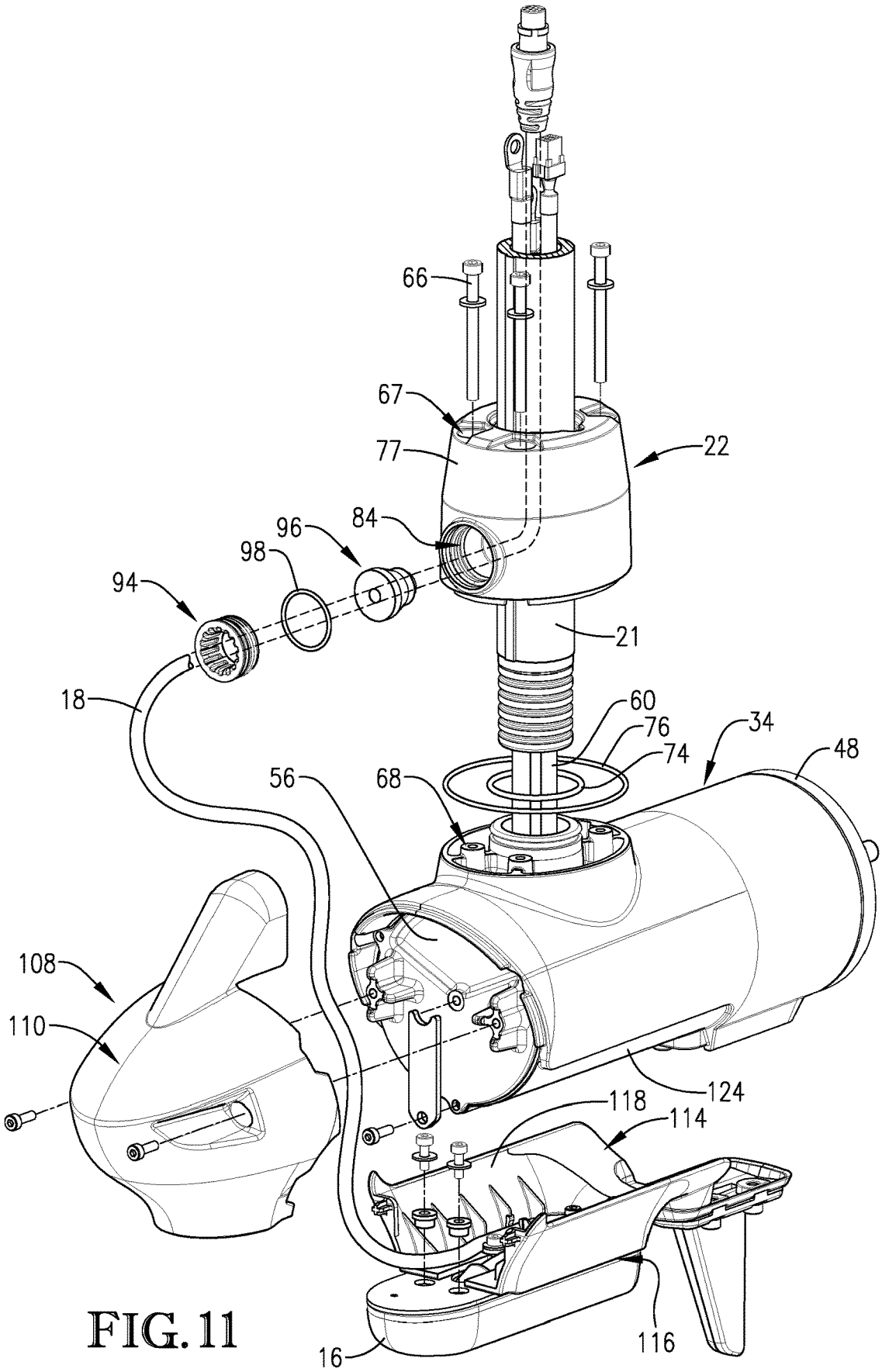
FIG. 11 is an exploded partial view of the motor assembly and downshaft assembly of FIG. 1.
Figure 12:
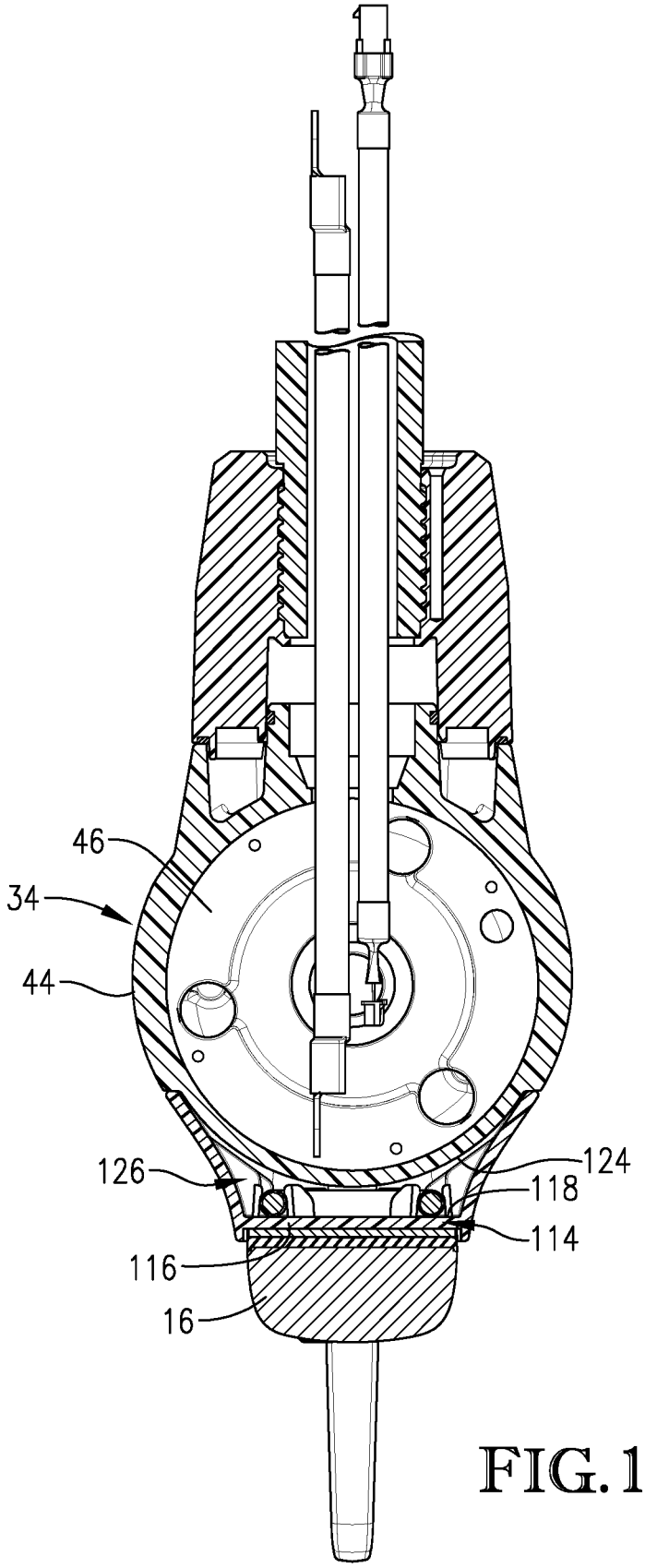
FIG. 12 is a vertical cross section of the motor assembly and downshaft assembly of FIG. 1 cut upon the center axis of the base and looking toward the rear of the motor assembly.
Figure 13:
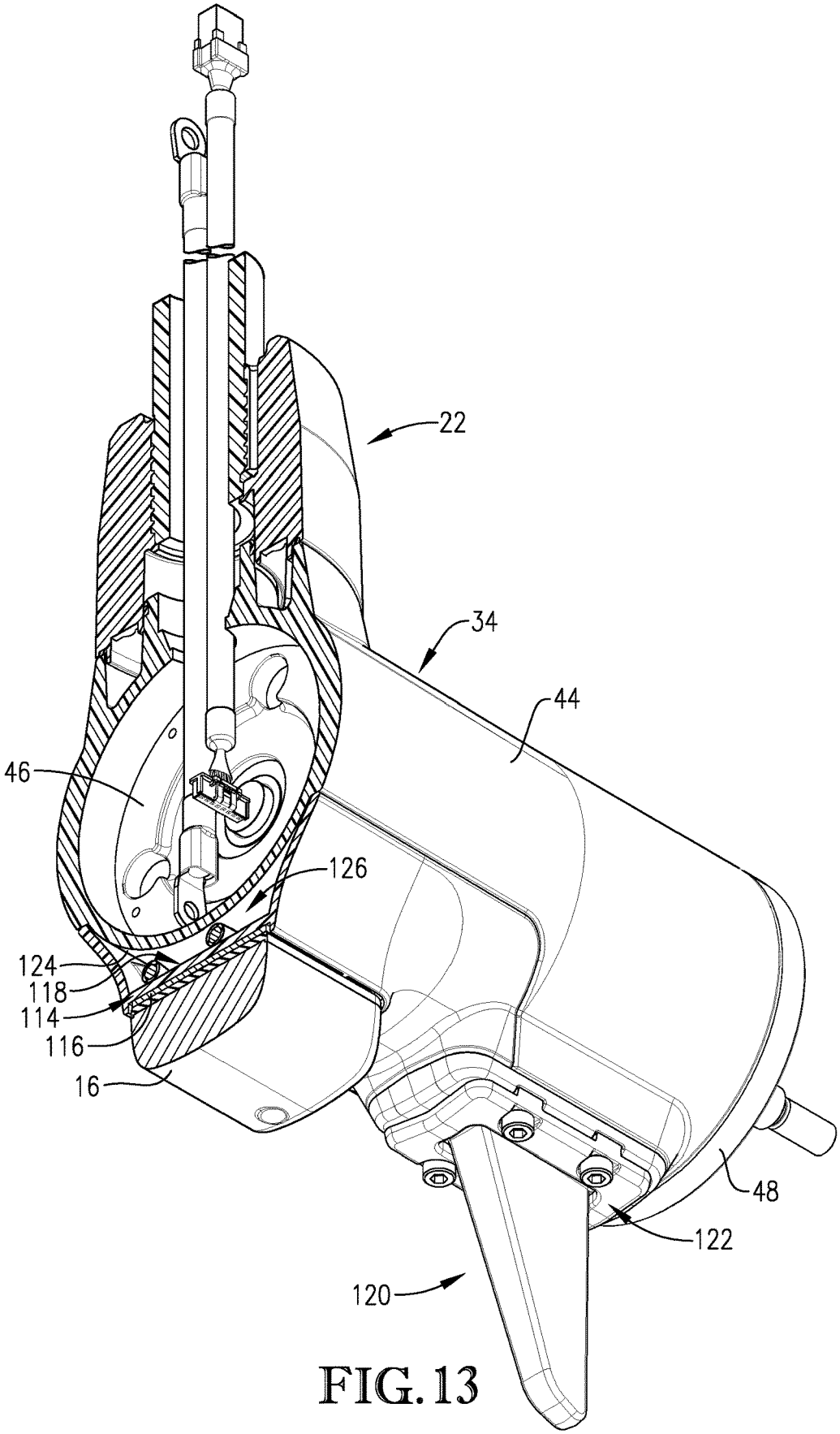
FIG. 13 is the vertical cross section of FIG. 12 taken at a rotated angle from FIG. 12.
Figure 14:
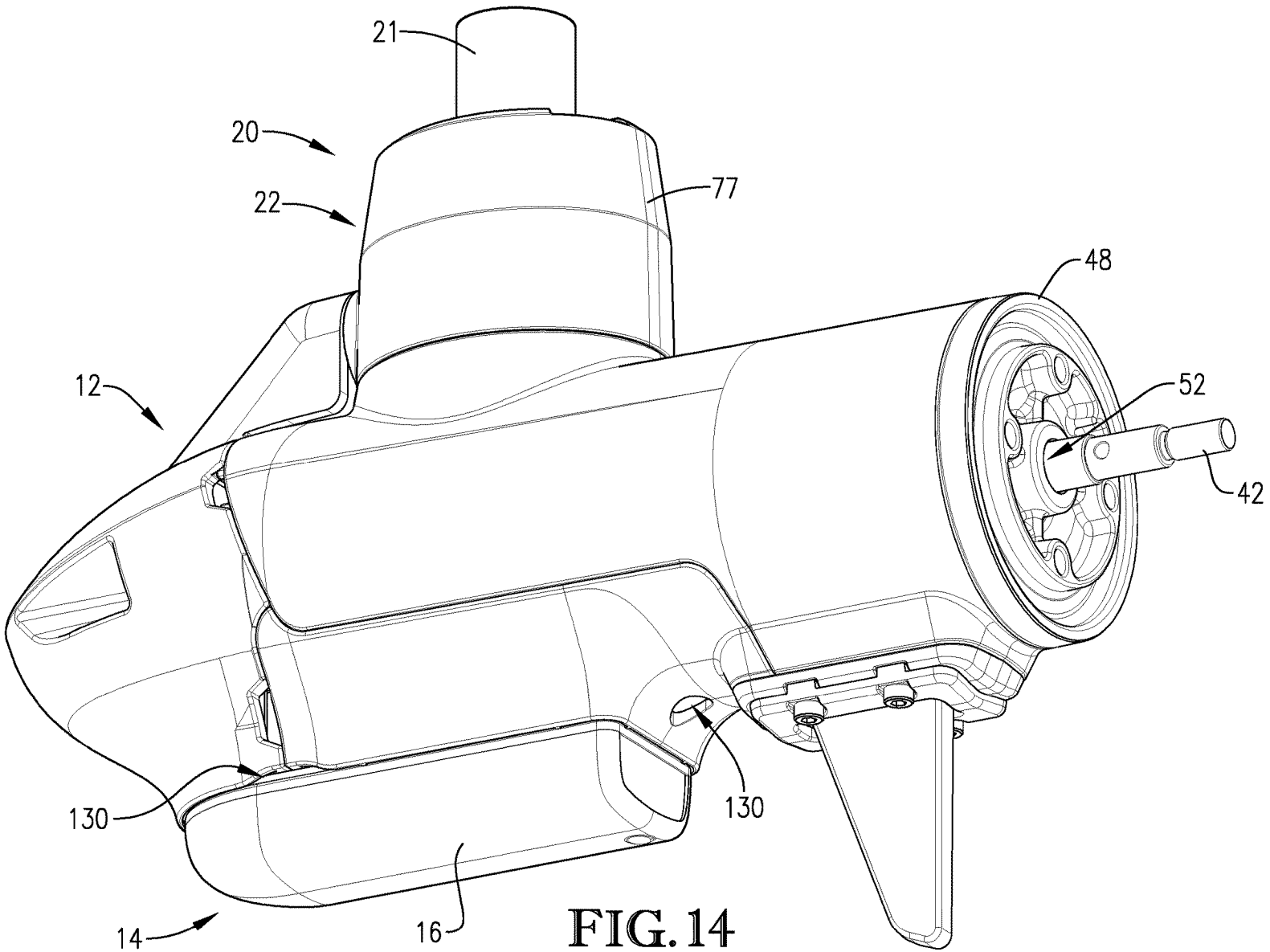
FIG. 14 is a rear perspective of the motor assembly and downshaft assembly of FIG. 1.
Figure 15:
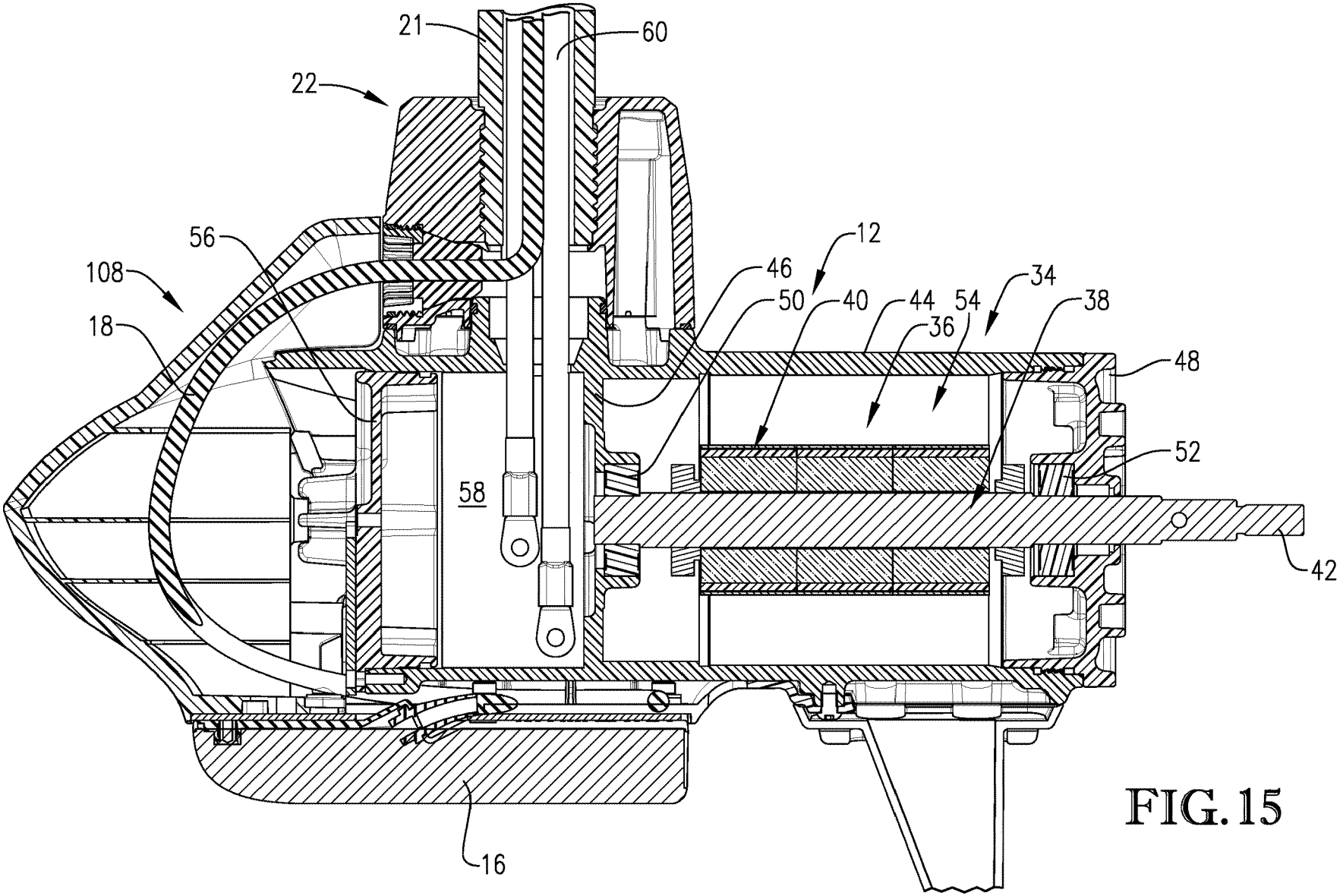
FIG. 15 is a vertical cross section of the motor assembly and downshaft assembly of FIG. 1 cut upon a center axis of a motor shaft of the motor assembly and looking toward a side of the motor assembly.

Referring specifically to FIG. 10, the base 22 also includes an exterior surface 77, an interior surface 78 defining an interior passage 80, and a surface 82 defining a hole 84 extending between the interior passage 80 and the exterior/exterior surface 77. The surface 82 includes a tapered segment 86, a threaded segment 88, a stopping face 90 between the tapered segment 86 and the threaded segment 88, and a sealing face 92 between the threaded segment 88 and the exterior surface 77. Although base 22 is shown elevated above the lower portion of shaft 21 in FIG. 11, it may be positioned at any location on shaft 21, including through integration with the lower portion of shaft 21 as illustrated in FIG. 5 for example.

The base 22 also includes a nut 94, a grommet 96, and an o-ring 98. The grommet 96 is a split grommet seal and includes a tapered portion 97 and an outer face 99. The nut 94 includes an outer surface comprising threads 100. The nut 94 also includes an interior surface 102 defining a hollow 104 and a plurality of teeth 106. The o-ring 98 fits around the outer surface of the nut 94 adjacent an outside end.

Transducer assembly 14, as outlined above, may be a replacement transducer array. An exemplary method for installing the new transducer assembly 14 may include splitting the grommet 96 and slipping the grommet 96 over the cable 18. The nut 94 and o-ring 98 may be inserted over an end of the cable 18. The cable 18 may be fed through the nut 94, the interior passage 80 and a corresponding interior of the shaft 21 until the end reaches the shaft cap 28. The grommet 96 may be inserted into the hole 84, and the nut 94 (with assembled o-ring 98) may be positioned behind the grommet 96.

A tool including teeth configured to mesh with or otherwise engage the teeth 106 of the nut 94 may be used to rotate and tighten the nut 94 (with assembled o-ring 98) within the hole 84. The nut 94 presses against the outer face 99 of the grommet 96 as the nut 94 is threaded into the hole 84, compressing an interior surface of the grommet 96 about an outer surface of the cable 18 to form a seal. The grommet 96—and, more particularly, the tapered portion 97—is also thereby pressed against the tapered segment 86 (and, optionally, elsewhere along the surface 82) in a funneling action to form a seal. The nut 94 may be tightened until it reaches and is halted by the smaller-diameter stopping face 90. Further, the o-ring 98 has a resting outer diameter marginally larger than that of the sealing face 92, and the threading process outlined above forces compression of the o-ring 98 to the diameter of the sealing face 92 and formation of a seal thereagainst. In configurations, the o-ring 98 may be omitted depending on the corrosion resistance of various parts of the motor 10.

It is foreseen that a sealing system may omit the o-ring and/or that other sealing components may be incorporated (such as thread seal tape around the threads of a nut), and that other ways of removably fixing the nut to the rest of a base and compressing a grommet may be employed, without departing from the spirit of the present technology.

In various embodiments, the motor case 34 and downshaft assembly 20 coupled thereto substantially seal against the ingress of water into the interior passage 80, the terminal compartment 58 and/or the motor compartment 54. The interior passage 80 may be in fluid communication with the terminal compartment 58, and the cables 60 may pass from the interior passage 80 to the terminal compartment 58. It is also foreseen that a fluid seal may be incorporated between an interior passage and a terminal compartment without departing from the spirit of the present technology. One of ordinary skill will also appreciate that the shaft 21 is fixed or removably attached to the base 22 in a manner that ensures substantial sealing therebetween during operation of the trolling motor 10.

The path of the cable 18 to the shaft cap 28 bypasses the motor compartment 54 and the terminal compartment 58. Rather than penetrating the case 34, the cable 18 travels around the case 34 to be received by the downshaft assembly 20. This routing of the cable 18 protects the primary structural components of the case 34 from potential source(s) of failure or leakage, for example, but also creates potential for exposure for the cable 18 along this length.

The motor assembly 12 also includes a nose cone 108 to protect the cable 18 along an otherwise exposed length (as discussed immediately above). The nose cone 108 has a nose portion 110 including a wall 112. An external surface of the nose portion 110 may form a hydrodynamic profile or hydrodynamic contour. The nose cone 108 also includes a bottom wall 114. The bottom wall 114 includes a first side 116 and a substantially opposite second side 118. The first side 116 is configured to be fixed against the transducer element 16 and against a skeg 120 and an anode 122. The transducer element 16, skeg 120 and anode 122 are removably secured to the first side 116 of the bottom wall 114 by fasteners such as screws or the like. The nose cone 108 is likewise secured against the motor case 34 by fasteners such as screws or the like. In each case, such removably secured components may be replaced with newer and/or upgraded parts as needed.

Moreover, the case 34—and, more specifically, the shell 44—may include a bottom outer surface 124. (See FIG. 11) The nose cone 108 is secured to the case 34 so that the second side 118 of the bottom wall 114 is at a remove from the bottom outer surface 124 to define a heat exchange cavity 126 therebetween. (See FIG. 12) Similarly, the nose cone 108 is secured to the case 34 so that the wall 112 of the nose portion 110 is at a remove from the secondary bulkhead 56 to define a second heat exchange cavity 128 therebetween. (See FIG. 8)

The nose cone 108 includes a plurality of apertures 130 (see FIG. 14) permitting movement of fluid (e.g., water) from the surroundings into and out of the heat exchange cavities 126, 128. In configurations, the fluid is at a lower temperature than the motor case 34. Flow of such coolant fluid within the cavities 126, 128 may enhance cooling via provision of additional cooling surfaces along the case 34 that might otherwise be insulated by transducer assemblies, nose cones and/or the like.

Further, the cable 18 extends from connection to the transducer element 16 through one or both of the cavities 126, 128 on the path to the interior passage 80. (See FIGS. 5 and 8) Advantageously, the nose cone 108 may protect the cable 18 from collision with objects in the surroundings along all or substantially all of the path from the transducer element 16 to the interior passage 80.

Relational terms, such as "upper", "lower", "top", "bottom", "outer", "inner", etc., may be used throughout this description. These terms are used with reference to embodiments of the technology and the orientations thereof shown in the accompanying figures. Embodiments of the technology may be oriented in ways other than those shown in the figures. Therefore, the terms do not limit the scope of the present technology.

Although the technology has been described with reference to the embodiments illustrated in the attached drawing figures, it is noted that equivalents may be employed and substitutions made herein without departing from the scope of the technology. The drawing figures do not limit the present technology to the specific embodiments disclosed and described herein.

What is claimed is:

1. A watercraft trolling motor for attachment to a transducer assembly having a transducer element and a cable, the trolling motor comprising:

a motor assembly including a motor and a propeller; and a downshaft assembly configured for attachment to the watercraft, the downshaft assembly defining an interior passage and including a base attached to the motor assembly;

the base including— a surface within a side wall of the base defining a hole extending between the interior passage and an exterior of the base, a nut, a grommet having a tapered portion at least partially disposed in the hole, wherein— the grommet is configured to receive the cable therethrough, the nut is positioned against the grommet and removably secured to the base, with the positioning of the secured nut compressing at least part of the tapered portion of the grommet against the surface defining the hole.

2. The trolling motor of claim 1, further comprising a steering assembly mounted to a bracket, the bracket being configured to be secured to the watercraft and the downshaft assembly being rotatably attached to the steering assembly.

3. The trolling motor of claim 1, wherein the grommet is a split grommet seal.

4. The trolling motor of claim 1, wherein the surface defines threading and generally includes a conical portion and the nut has an outer surface that defines corresponding threading.

5. The trolling motor of claim 4, wherein the base further includes a removable o-ring secured between the outer surface of the nut and the surface defining the hole to form a seal.

6. The trolling motor of claim 1, wherein the nut defines an interior hollow for receiving the cable and includes an interior surface defining one or more teeth configured for insertion into corresponding slots of a tool for loosening or tightening the nut within the hole of the base.

7. The trolling motor of claim 1, wherein the downshaft assembly substantially seals the interior passage from ingress of liquids from the exterior of the base with a liquid ingress protection rating of at least seven (7) according to International Electrotechnical Commission (IEC) 60529.

8. The trolling motor of claim 1, wherein the base of the downshaft assembly is removably coupled to and sealed against the motor assembly.

9. A downshaft assembly for supporting a motor assembly of a watercraft and for enclosing a cable of a transducer assembly fixed to the motor assembly, the downshaft assembly comprising:

a base having an exterior surface, an interior surface, and a surface within a side wall of the base defining a hole extending between the interior surface and the exterior surface;

a grommet having a tapered portion at least partially disposed in the hole; and a nut, wherein— the grommet is configured to receive the cable therethrough, the nut is positioned against the grommet and removably secured to the base, with the positioning of the secured nut compressing at least part of the tapered portion of the grommet against the surface defining the hole.

10. The downshaft assembly of claim 9, wherein the grommet is a split grommet seal.

11. The downshaft assembly of claim 9, wherein the surface defines threading and includes a generally conical portion and the nut has an outer surface that defines corresponding threading.

12. The downshaft assembly of claim 11, wherein the base further includes a removable o-ring secured between the outer surface of the nut and the surface defining the hole to form a seal.

13. The downshaft assembly of claim 9, wherein the nut defines an interior hollow for receiving the cable and includes an interior surface defining one or more teeth configured for insertion into corresponding slots of a tool for loosening or tightening the nut within the hole of the base.

14. The downshaft assembly of claim 9, wherein the interior surface is substantially sealed from ingress of liquids with a liquid ingress protection rating of at least seven (7) according to International Electrotechnical Commission (IEC) 60529.

15. The downshaft assembly of claim 9, wherein the base of the downshaft assembly is removably coupled to and sealed against the motor assembly.

16. A watercraft-propulsion motor assembly configured for attachment to a transducer assembly including a transducer element and a cable, the motor assembly comprising:

a motor including a rotor;

a case containing the rotor and having a bottom outer surface; and a nose cone having a bottom wall, wherein— the bottom wall is configured to be secured against the transducer element, the nose cone is removably fixed to the case to define a heat exchange cavity between the bottom wall and the bottom outer surface of the case, the nose cone is configured to permit ingress of liquid into the heat exchange cavity from an ambient environment.

17. The motor assembly of claim 16, wherein— the case defines a motor compartment containing the rotor, the case substantially seals against the ingress of liquid into the motor compartment.

18. The motor assembly of claim 17, further comprising— a shaft fixed to the rotor and having first and second ends, wherein— the case includes first and second axial ends, a propeller is fixed to the first end of the shaft adjacent the first axial end of the case, the nose cone includes a nose portion having a second wall, the nose cone is removably fixed to the case to define a second heat exchange cavity between the second wall and the second axial end of the case, the heat exchange cavity and the second heat exchange cavity are in fluid communication with one another.

19. The motor assembly of claim 18, wherein the nose cone is configured to receive the cable through the heat exchange cavity and the second heat exchange cavity.

20. The motor assembly of claim 16, further comprising a skeg and an anode removably fixed to the nose cone.

* * * * *